US007178455B2

(12) United States Patent
Jacq et al.

(10) Patent No.: US 7,178,455 B2
(45) Date of Patent: Feb. 20, 2007

(54) COMPACTING PRESS

(75) Inventors: Patrick Jacq, Montelimar (FR); Philippe Kerrien, Le Mesnil Saint Denis (FR)

(73) Assignee: Compagnie Generale des Matieres Nucleaires, Velizy-Villaboublay (FR)

( * ) Notice: Subject to any disclaimer, the term of this patent is extended or adjusted under 35 U.S.C. 154(b) by 66 days.

(21) Appl. No.: 10/895,708

(22) Filed: Jul. 21, 2004

(65) Prior Publication Data

US 2005/0105674 A1 May 19, 2005

(30) Foreign Application Priority Data

Jul. 22, 2003 (FR) ..... 03 08913

(51) Int. Cl.
*B30B 9/32* (2006.01)

(52) U.S. Cl. ..... 100/229 R; 100/218; 100/902

(58) Field of Classification Search ..... 100/214, 100/215, 229 A, 246, 902, 218, 229 R; 29/33.2, 29/33.5, 56.5; 483/14, 44, 49; 72/444, 446, 72/448

See application file for complete search history.

(56) References Cited

U.S. PATENT DOCUMENTS 4,631,015 A * 12/1986 Shigeo et al. ..... 425/195
4,685,391 A 8/1987 Picker
5,323,698 A 6/1994 Prevost
5,613,433 A 3/1997 Tucoulat et al.
5,775,212 A * 7/1998 Takao ..... 100/214
6,048,419 A 4/2000 Guerin et al.
6,110,307 A * 8/2000 Guerin et al. ..... 149/108.4

FOREIGN PATENT DOCUMENTS

| | | |
|---|---|---|
| EP | 0 035 568 | 9/1981 |
| FR | 2 700 494 | 7/1994 |
| JP | 62127198 | 6/1987 |
| WO | WO 97/13254 | 4/1997 |

* cited by examiner

*Primary Examiner*—Lowell A. Larson
*Assistant Examiner*—Jimmy Nguyen
(74) *Attorney, Agent, or Firm*—Cohen Pontani Lieberman & Pavane LLC

(57) ABSTRACT

A compacting press having a support section, a compacting section which undergoes translational movement along a vertical axis (Z, Z') which is fitted with a thrust-plate and which forms a ram designed to compress cases by the application of pressure, and a guide assembly made up of a skirt, with a liner, a hoop and a cradle. The cradle is fitted to a skirt holding section by a removable connection made up of a reversible assembly system involving the fitting into place and horizontal movement of at least one key-hole shaped opening which passes vertically through the cradle and at least one vertically orientated mushroom-shaped lug. This press is preferably used for compacting a case containing hazardous materials, in particular radioactive waste.

11 Claims, 7 Drawing Sheets

COMPACTING PRESS

BACKGROUND OF THE INVENTION

1. Field of the Invention

The invention is concerned with a press for compacting a case containing hazardous materials, radioactive waste in particular.

Such hazardous materials include, in particular, waste produced by the reprocessing of used nuclear fuels.

2. Discussion of Related Art

Remote-controlled presses for compacting cases made up of containers holding hazardous materials have been suggested for use in particular, in areas of low radioactivity, where human intervention is possible without risk and particularly for reasons associated with the maintenance of the equipment (repair or replacement).

In other scenarios it is impossible for human beings to carry out interventions on the press which will be installed in a hazardous environment, without there being danger involved, especially where radioactivity may reach excessively high levels. A press of this type is described in document FR 2 700 494.

SUMMARY OF THE INVENTION

The Press in the invention is used in particular (but not exclusively) for compacting cases made up of cylindrical containers fitted with a cover, which contain hazardous materials and whose volume it is desired to reduce, in particular to optimize their storage volume.

The intention of the present invention is to provide a compacting press that may be remotely dismantled so that the component or components to be inspected and/or repaired may be brought into a space that is accessible to maintenance operatives using remotely operated tools, and placed in a low contamination environment, in particular where this space is located above or next to the contaminated zone where compacting is carried out.

To this end the invention involves a press for compacting a case which contains hazardous materials, in particular radioactive waste, and which is made up of:

- a section for supporting the aforementioned case, equipped with a block and fitted in a removable manner onto a lower support beam,
- a compacting section which can undergo translational movement along a vertical axis (Z, Z'), which is fitted above the said support section and which is equipped with a thrust-plate which forms a ram designed to compress the aforementioned case through the application of pressure, and
- a guide assembly for the compacting section which is designed to receive one free end of the said compacting section and which encloses the aforementioned case, with the aforementioned guide assembly being made up of skirt which has:
- a liner resting on the block of the aforementioned support section and which is designed to tightly enclose the periphery of the aforementioned case,
- a hoop which surrounds the aforementioned liner tightly, and
- a cradle onto which the aforementioned hoop is fixed.

In the invention, the aforementioned cradle is mounted, by means of a removable connection, onto a skirt holding section, which can undergo vertical translation movement, with the aforementioned removable connection including a reversible system for assembly using the fitting together of parts and horizontal movement, with the aforementioned horizontal movement taking place in one plane, between the aforementioned cradle and the aforementioned holding section when in a maintenance position.

In this way, assembly and disassembly of the cradle and the skirt holding section can be easily accomplished.

In addition, it should be noted that this arrangement advantageously allows the compacting skirt to be removed as a single block, since during the operation for separating the cradle from its holding section, the skirt and the hoop remain fixed to the cradle.

The aforementioned reversible assembly system advantageously includes at least one key-hole shaped opening which passes vertically through the aforementioned cradle and at least one mushroom-shaped lug pointing vertically downwards from the aforementioned skirt holding section.

Thus it can be seen that in the aforementioned maintenance position the cradle may be readily separated from its holding section by placing the cradle (or more precisely the entire skirt made up of the cradle, the hoop and the liner), in a lowered position, onto a maintenance trolley before it is separated from its holding section.

The skirt (the cradle, hoop and liner) can then be separated from the holding section by releasing the trolley supporting the cradle.

The aforementioned reversible assembly system would preferably include two keyhole-shaped openings in the form of a slot, arranged on the aforementioned cradle and passing through it vertically, and two matching mushroom-shaped lugs pointing vertically downwards and fitted to the aforementioned skirt holding section. Assembly and disassembly of the removable connection is then carried out through the fitting together and horizontal translation movement of the aforementioned lugs and the aforementioned openings whilst in the aforementioned maintenance position.

This type of reversible assembly system allows the removable connection to be assembled and disassembled through the fitting together and horizontal translation movement of the aforementioned lugs and aforementioned openings in the aforementioned maintenance position, and has the particular advantage of being simple to fabricate and to use whilst ensuring that there is reliable separation of the skirt and the holding section when in the aforementioned maintenance position.

A removable connection of a bayonet type (interlocking and rotation around a vertical axis) could also be employed.

At least one of the two aforementioned openings might preferably be designed to open out in a lateral direction: this configuration would further simplify the separation of the skirt from its holding section.

Another advantageous arrangement would be to also have the press include means for limiting the vertical travel of the skirt holding section, so that the aforementioned skirt and the aforementioned holding section may be placed in the aforementioned maintenance position: this arrangement would ensure the correct vertical positioning of the skirt for separation of the skirt from its holding section when the skirt is resting on the trolley.

In particular, the inclusion of the piston rod of at least one auxiliary cylinder may be foreseen in the aforementioned skirt holding section.

The aforementioned limiting means would preferably include an end stop and a removable spacer, with the aforementioned end stop being fitted so that it is fixed to the aforementioned piston rod above the aforementioned spacer, so that contact between the aforementioned end-stop and the aforementioned spacer would prevent the aforementioned piston rod from descending, and would place the piston rod in the aforementioned maintenance position.

This end-stop system has the particular advantage of being relatively simple and also of not hindering the movement of the aforementioned piston rod.

A bellows is arranged effectively coaxially with the aforementioned piston rod, with the upper end of the aforementioned bellows forming a sealed connection with the aforementioned piston-rod, underneath the said end-stop, with the lower end of the aforementioned bellows making a sealed connection to a partition. In this way the bellows forms a sealing element between the lower zone and the upper zone as will be described below in detail.

In order to facilitate and guide the vertical movements of the cradle, and therefore of the skirt, it is also foreseen that the aforementioned guide assembly should preferably also include at least three columns surrounding the support section and the compacting section, and that these three columns be fitted with guide-ways which extend vertically, and that the aforementioned cradle be equipped with at least three shoes, with each shoe being designed to slide vertically in a matching guide-way.

It is foreseen in particular that in order to facilitate the separation of the skirt at least one of the guide-ways be fitted with at least one cut-out, whereby the corresponding shoe on the cradle may be made to emerge from the guide-way by means of a horizontal movement.

For example, in one preferred example of construction the press includes four guide-ways each of which is mounted on one of four columns, with at least two of the guide-ways being equipped with at least one cut-out; preferably two of the guide-ways are equipped with three cut-outs evenly spaced one beneath the other.

In another advantageous arrangement, the aforementioned compacting section also includes an intermediate thrust-plate fitted above the aforementioned thrust-plate, a cylinder ram fitted above the aforementioned intermediate thrust-plate and a fixing assembly which connects the aforementioned thrust-plate, aforementioned intermediate thrust plate and aforementioned cylinder-ram together, with the aforementioned compacting section being of cylindrical cross-section around the aforementioned vertical axis (Z, Z'). The aforementioned fixing assembly comprises:

a fixing rod that is coaxial with the aforementioned vertical axis (Z, Z') with the lower extremity of the aforementioned fixing rod passing into the bore of the aforementioned intermediate thrust-plate. The aforementioned fixing rod is threaded onto a threaded insert which mates with an internal thread which makes up a section of the bore of the aforementioned intermediate thrust-plate;

a dynamometric screw whose lower end is threaded and which mates with an internal thread on the aforementioned thrust-plate, with the upper part of the aforementioned dynamometric screw being connected to the aforementioned fixing rod and to the aforementioned intermediate thrust-plate by means of a threaded insert, with the said dynamometric screw having an intermediate portion with a fragile section, preferably in the form of a bobbin.

This solution means that the thrust-plate may be released from the remainder of the compacting section when the thrust-plate is gripped in the lining of the skirt and when the compacting section is being separated from the skirt, that is, when the compacting part is being raised.

In another advantageous arrangement, the aforementioned lower support beam is connected to a centering component which mates with the base of the block, with the aforementioned block having a lateral face which possesses an upper portion in the form of a truncated cone which gets larger towards the base as well as a lower portion which forms a recessed shoulder, preferably annular.

This arrangement, in conjunction with having the internal face of the liner wall with a lower tapered portion at the same angle as the tapered cone of the upper part of the lateral face of the block, provides a centred and stable support for the skirt on the block. This support is reinforced by the fact that the skirt is connected to the aforementioned skirt holding section, the bottom of which is supported on the cradle of the skirt.

Furthermore, the recessed shoulder of the lower portion of the lateral face of the block greatly facilitates the operation of holding this part of the press using a matching grab during maintenance.

BRIEF DESCRIPTION OF THE DRAWINGS

The invention can be more easily understood by referring to the non-restrictive example given hereafter which describe one method of construction of this invention. In this example, some of the secondary characteristics of the invention will be specified.

This example of construction is illustrated in the following figures.

DETAILED DESCRIPTION OF THE PRESENTLY PREFERRED EMBODIMENTS

Figure 1:
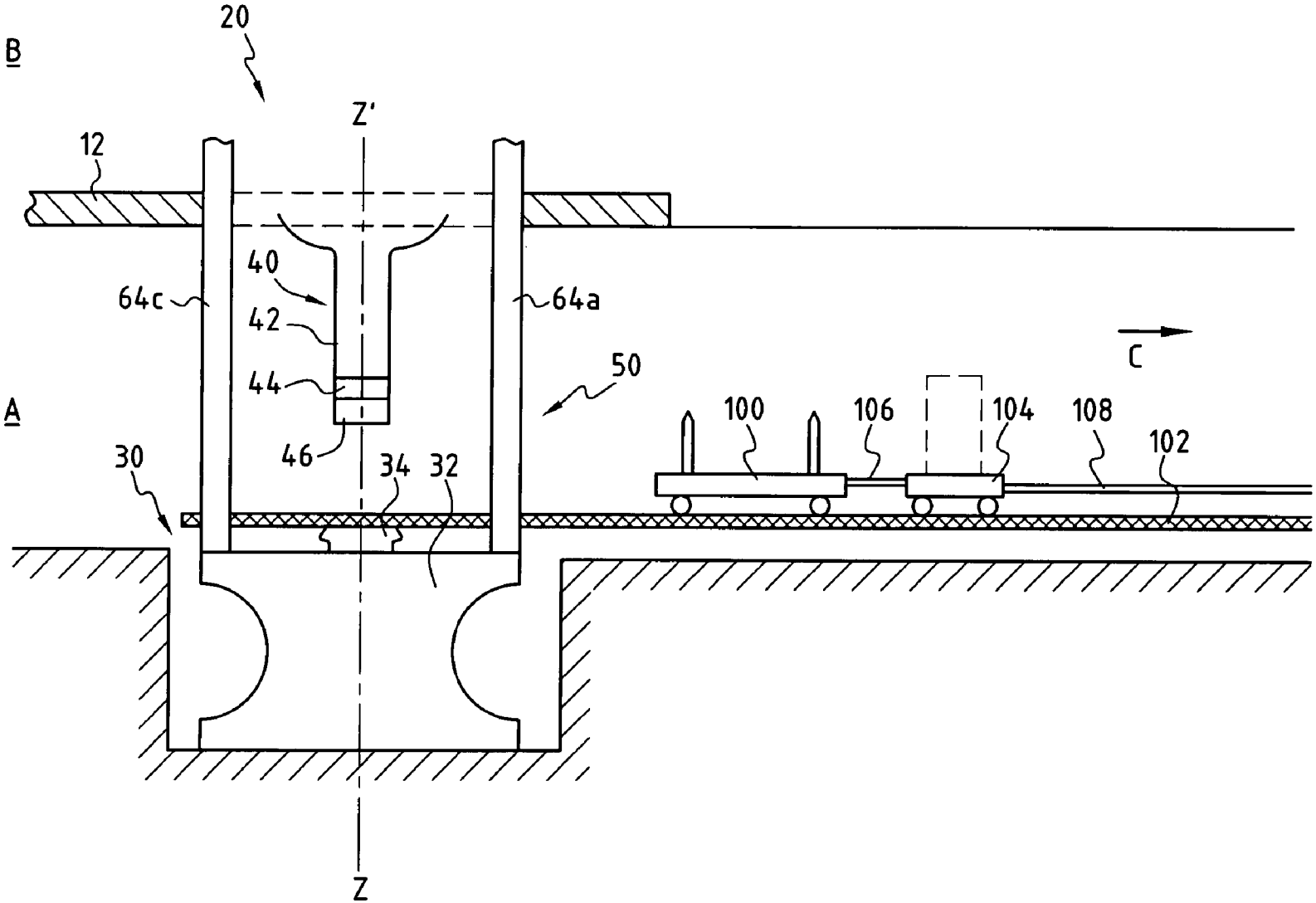
FIG. 1 is a schematic diagram illustrating the installation of the press as described in the invention.

FIG. 1 shows an example of an installation of compacting press 20 as described in the present invention.

As shown in FIG. 1 a lower zone A, formed by a space likely to be contaminated and which forms part of a compacting cell (or process cell) is located beneath a zone B, which is likely to be an uncontaminated zone and which forms part of a maintenance cell.

In zone A there can be seen (schematically) the lower part of compacting press 20, which includes a support section 30 designed to receive the case to be compacted (not shown), a compacting section 40 designed to compress the case and a guide assembly 50 for guiding the vertical translation movement of compacting section 40 whilst holding the case to be compacted.

In FIG. 1 only columns 64*a*, 64*c* of the guide assembly 50 are visible.

For the compacting section 40, FIG. 1 schematically shows moving ram cylinder 42 rising and falling through its direct connection to a fixing assembly 48 (not shown in FIG.

Figure 2:
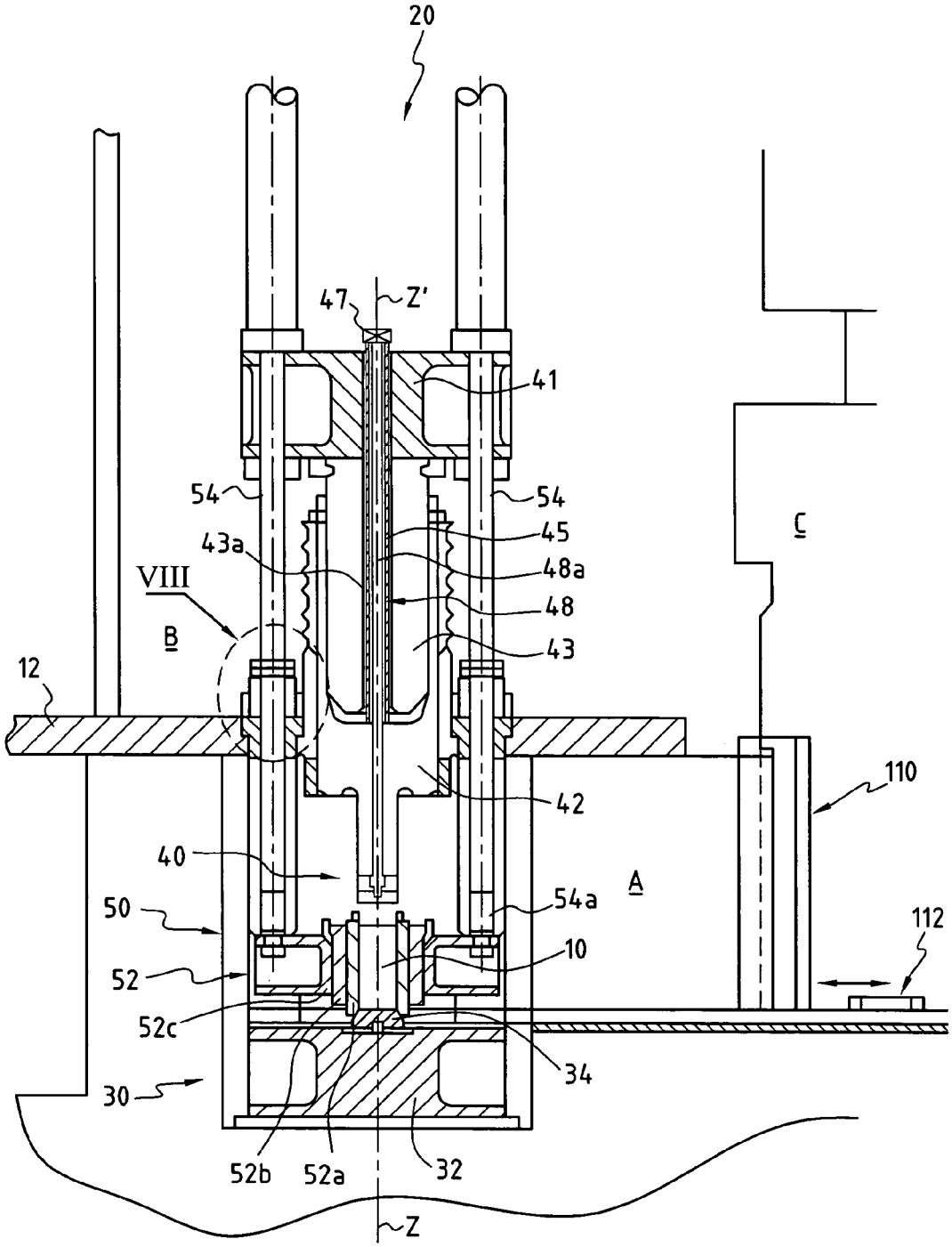
FIG. 2 is a simplified section view of the press as described in the invention.

1 but visible in FIG. 2), an intermediate thrust-plate 44 fitted to the extension and beneath the bottom end of ram cylinder 42, as well as a thrust-plate 46 which forms the wearing component of the equipment and which is fitted beneath intermediate thrust-plate 44.

Of the support section 30, FIG. 1 shows a lower support beam 32 beneath the block 34 which forms the wear component intended to directly support the case to be compacted.

It is therefore essentially the compacting cell that is shown as zone A in FIG. 1, and which is located to the left of another process cell (see arrow C).

It can therefore be seen that the compacting cell represents one of the work stations required to carry out the full compacting operation, and this process also requires a step involving loading of the case to be compacted, and a step involving release the compacted case or disk. One or more maintenance stations can also be envisaged.

It is envisaged that several trolleys be used to carry out the transfer of the case, disk or of one of the components of the compacting press:

maintenance trolley 100 might run on rails 102 laid between zone A and zone C, with this maintenance trolley 100 being designed to receive skirt 52 of guide assembly 50, as will be explained below;

a transfer trolley 104 will be used for transporting the case before it is compacted and the disk produced by compaction, with this transfer trolley 104 being connected to maintenance trolley 100 through a coupling system 106.

This assembly of trolley 100 and 104 is driven to the right or left in FIG. 1 by means of a drive train 108.

Reference will now be made to FIG. 2 in which press 20 is shown in a more complete fashion.

The support section 30, compacting section 40 and a part of the guide assembly 50 of press 20 are therefore all located in the compacting cell (located in zone A) which is to the left of process cell C, with moving vertical partitions (on slides) 110 used to separate the two zones A and C.

A horizontal partition 12 is used to separate the two zones A and B which are above one another.

FIG. 2 also schematically shows a transfer system 112 used to load (and unload) the case or disk onto (or off) transfer trolley 104, with this transfer system 112 being directly connected to the appropriate equipment in process cell C.

FIG. 2 shows the part of press 20 located in zone A as well as a portion of the upper part of press 20 which is found in zone B.

FIG. 2 shows a case 10 before compacting, with this case 10 enclosed in a skirt 52 which is part of guide assembly 50.

Above this skirt 52 is a skirt holding section made up of two auxiliary skirt cylinders 54 whose upper sections extend into zone B, which is separated from zone A by partition 12.

Figure 7:
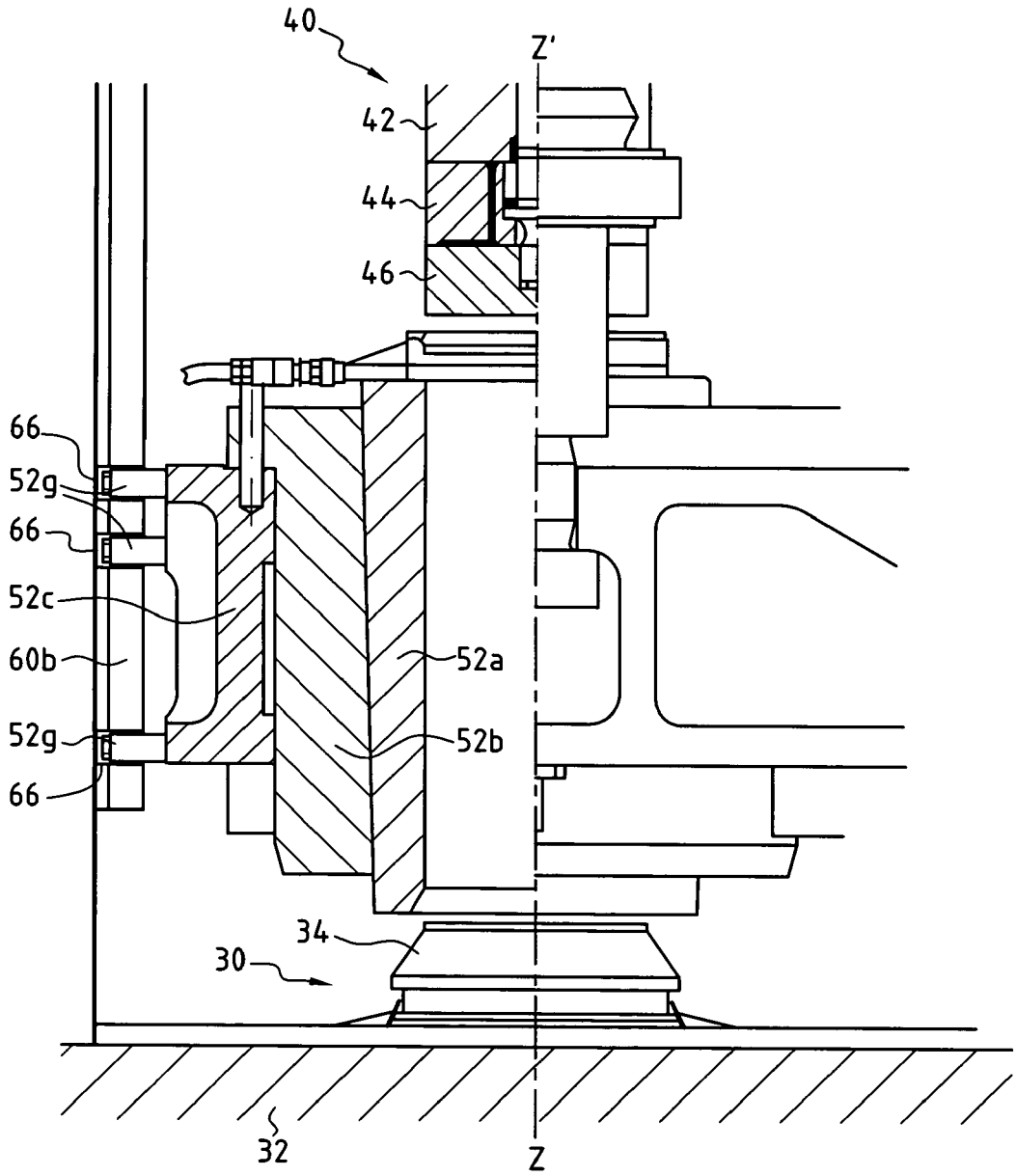
FIG. 7 is a half-section, through VII—VII of FIG. 6, and a projection half-section in direction VII' of FIG. 6, showing the guide assembly of the compacting section of the press in FIG. 2.

Skirt 52 is fitted with a liner 52*a* designed to surround case 10, with this liner 52*a* itself being located in a hoop 52*b* mounted on a cradle 52*c* (see also FIG. 7).

The ram cylinder 42 is fitted around the lower part of rod 48*a* of the fixing assembly 48 located mostly in zone B, with the lower part of rod 48*a* being able to enter zone A.

FIG. 2 also shows the vertical axis Z, Z' which forms an axis of symmetry for the press 20. This axis Z, Z' is coaxial with cylinder ram 42 which can move vertically and is fixed to rod 48*a* of the fixing assembly 48, and which is therefore also made to move during the rise and fall of the compacting section 40.

More precisely, as shown in FIG. 2, rod 48*a* of the fixing assembly 48 is fixed to cylinder 42, whose upper part forms an open cylindrical volume, the top which houses a fixed piston 43 which is mounted so that it is fixed to the frame 41 of press 20. This fixed piston 43 is crossed, coaxially with Z, Z', by a bore 43*a* which receives a tube 45 forming a vertical brace. The upper end of this tube 45 is fixed by means of an assembly (fitted using fastenings 47) to the upper end of fixing rod 48*a*. The lower end of tube 45 presses on the base of the cylindrical volume of cylinder ram 42.

Tube 45 therefore forms a mechanical fixed link whilst transmitting to both these components (fixing rod 48*a* and ram cylinder 42) the tightening force exerted by fastening assembly 47.

Rod 48*a* of the fixing assembly 48 is arranged coaxially with axis (Z, Z') in tube 45, with the upper portion of rod 48*a* being free to move in vertical translation inside a guide opening provided in frame 41, whilst the lower extremity of this rod 48*a* is fixed to the compacting section 40 as will be explained below in relation to FIG. 4.

The vertical slide movement of the assembly formed by the compacting part 40 (comprising cylinder ram 42, intermediate thrust-plate 44 and thrust-plate 46) and the fixing rod 48*a*, relative to fixed piston 43 is produced by the introduction or withdrawal of pressurised fluid in the space between fixed piston 43 and ram cylinder 42, into the aforementioned open cylindrical space of cylinder 42, and which imparts vertical translation motion to ram cylinder 42.

Figure 3:
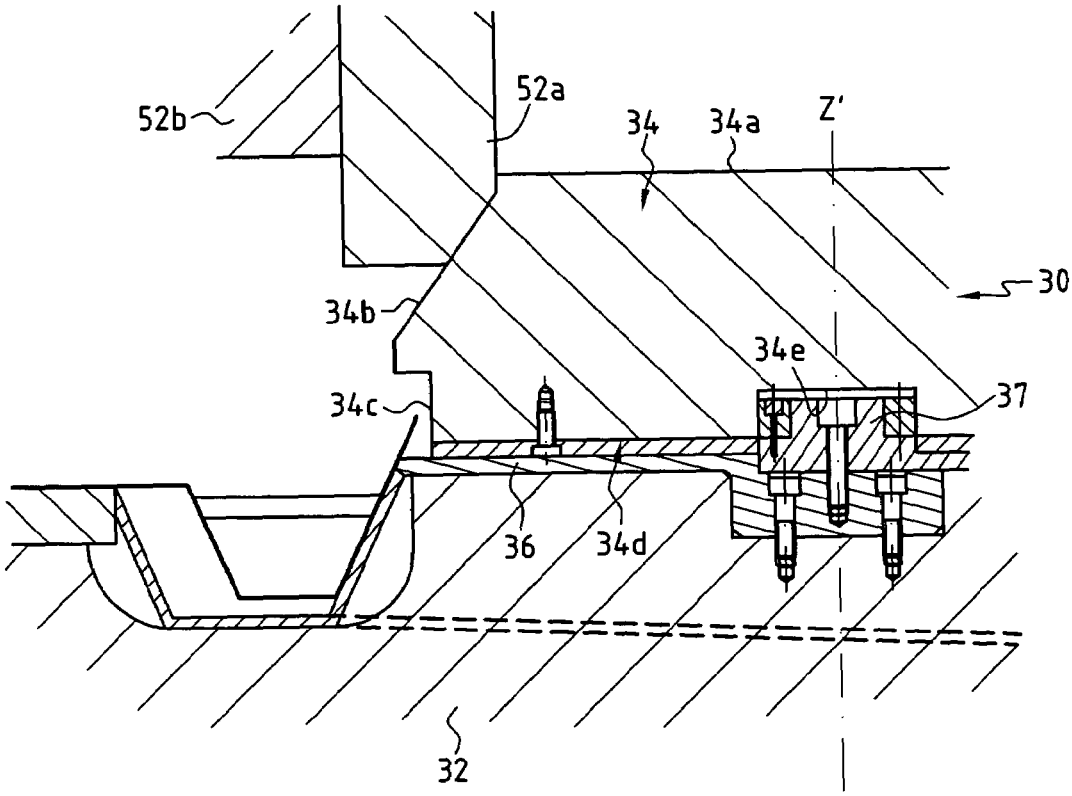
FIG. 3 is an enlarged partial cross-sectional view of the support section of the press in FIG. 2.

Reference will now be made to FIG. 3, which shows a partial enlarged view of the support section 30.

Block 34 has a flat upper surface 34*a* upon which the base of the case rests, as well as a lateral face 34*b* which has an upper portion in the form of a truncated cone which increases in size towards its base, as well as a lower portion which forms a recessed shoulder 34*c*.

It can be clearly seen that lining 52*a* has a lower section with a tapered seat designed to mate with the upper portion of lateral face 34*b* of the block which is in the form of a truncated cone: this arrangement provides a high degree of stability and a distribution of compressive forces over block 34. This is important as the skirt 52 (lining 52*a*, hoop 52*b* and cradle 52*c*) rests on this lateral face 34*b* of block 34.

The connection between the block 34 and the lower support beam 32 can also be seen in FIG. 3: a centering element made up of a centering plate 36 and a centering insert 37 ensures that there is engagement with block 34 by centering it in relation to the lower support beam 32 in the following way: The lower face 34*d* of the block has a recessed housing 34*e* that is coaxial with the vertical axis Z, Z' and which receives the centering insert 37, which is itself bolted to the centering plate 36. Centering plate 36 is bolted to the upper face of the lower support beam 32.

Figure 4:
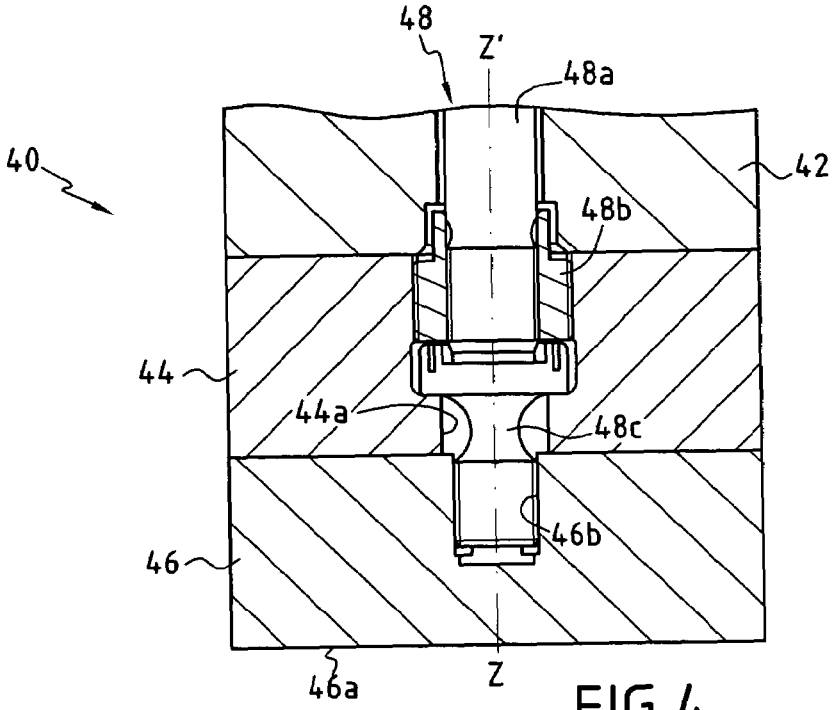
FIG. 4 is an enlarged partial cross-sectional view of the compacting section of the press in FIG. 2.

FIG. 4 describes the components found at the lower extremity of the compacting section 40.

Thrust-plate 46 is made up of a fixed thrust plate which acts as a wearing component: it is a cylinder of full circular cross-section whose flat lower face 46*a* is in contact with the case being compacted during the lowering of the compacting section 40. Its external diameter is set to be as near as possible the same as that of the internal diameter of liner 52*a* of skirt 52, without these two parts rubbing together.

The intermediate thrust-plate 44 is also made up of a cylinder of circular cross-section whose external diameter is slightly less than that of thrust plate 46. Intermediate thrust plate 44 is fitted between fixed thrust plate 46 and ram cylinder 42.

As seen from FIG. 2, rod 48*a* of the fixing assembly 48, located mainly in zone B (maintenance zone accessible for humans using remotely operated tools) is fixed to ram cylinder 42. These two components (ram cylinder 42 and fixing rod 48*a*) slide relative to frame 41 and relative to fixed piston 43 which extends the lower extremity of frame 41. In particular, the upper portion of fixing rod 48*a* slides inside fixed piston 43 and the upper part of ram cylinder 42 (which surrounds the aforementioned open topped cylindrical volume) slides outside fixed piston 43.

As can be seen from FIGS. 2 and 4, rod 48*a* of the fixing assembly 48 forms, at its lower part, a fixing rod that is coaxial with vertical axis Z, Z' and which passes through ram cylinder 42 over its entire length.

In order to connect the ram cylinder 42 to intermediate thrust plate 44, fixing rod 48*a* passes through bore 44*a*, across intermediate thrust plate 44 and is fixed and enclosed by a threaded insert 48*b* which is threaded onto the bottom end of fixing rod 48*a*. Naturally, since threaded insert 48*b* has a larger diameter than the bore in ram cylinder 42 (into which a section of the bottom extremity of fixing rod 48*a* passes), threaded insert 48*b* must be placed on the end of fixing rod 48*a* when the fixing rod 48*a* is already located in the bore of ram cylinder 42.

Threaded insert 48*b* is also threaded on its external surface to match an internally threaded portion of bore 44*a*, so that ram cylinder 42 and intermediate thrust plate 44 can also be fixed together.

As shown in FIG. 4, the connection between intermediate thrust plate 44 and fixed thrust plate 46 is achieved by means of a dynamometric screw 48*c* whose head (top part) rests under pressure on a shoulder machined in bore 44*a* of the intermediate thrust plate. The foot (bottom part) of dynamometric screw 48*c* is threaded and fits into an internal thread 46*b* provided in the upper part of fixed thrust plate 46, so that it is coaxial with the Z, Z' axis.

The dimensions, particularly the height, of the threaded insert 48*b* means that under pressure its bottom extremity comes onto the head of the dynamometric screw so as to lock the latter in the position shown in FIG. 4.

Between its head and its base, dynamometric screw 48*c* has an intermediate section with a built in fragile zone which does not come into contact with bore 44*a*. This fragile zone is created by means of a progressive constriction (reduction in diameter) between the head and the base, forming a type of bobbin whose thinnest section is dimensioned so that it will break when the thrust plate is seized in liner 52*a* of skirt 52 and when compacting section 40 (or more precisely the ram cylinder 42 connected to intermediate thrust plate 44) disengages from skirt 52 during return upwards movement of ram cylinder 42.

This arrangement means that compacting section 40 can be lifted, even when thrust plate 46 has seized, so that if skirt 52 of guide assembly 50 is being recovered, it will be possible to remove fixed thrust-plate 46 from skirt 52 (as will be detailed below).

In this case, repairs to compacting section 40 are carried out in zone B when ram cylinder 42 is in its highest elevated position by fitting a new dynamometric screw 48*c* and a new thrust plate 46.

Naturally, prior to replacing the dynamometric screw 48*c*, intermediate thrust-plate 44 must be removed by separating intermediate thrust-plate 44 from ram cylinder 42 and (in the event that it is still in place where rupture of the fragile zone of the intermediate section of dynamometric screw 48*c* is not complete) fixed thrust-plate 46. All that is required in order to do this is to unscrew the bottom end of fixing rod 48*a* from the threaded insert 48*b* using the top of rod 48*a* located in zone B.

Fixing rod 48*a* may then be separated from the upper part of press 20, in this case, all that is required is to unscrew fixing rod 48*a* in order to withdraw it out from ram cylinder 42, so that thrust-plates 44 and 46 may rest on maintenance trolley 100 which is placed beneath fixing assembly 48 by means of its transfer rail 102.

When insert 48*b* is withdrawn, the diameter of the internally threaded portion of bore 44*a* (which matches the external diameter of insert 48*b*) allows dynamometric screw 48*c* to pass through, specifically for maintenance purposes.

In order to prevent any rotation between, on one hand, intermediate thrust-plate 44 and ram cylinder 42, and, on the other hand, fixed thrust-plate 46, at least two locating fingers 49 (FIG. 5) are placed, respectively, between ram cylinder 42 and intermediate thrust-plate 44 and between intermediate thrust-plate 44 and fixed thrust-plate 46.

The operation of dismantling skirt 52 of press 20 by means of cradle 52*c* will now be explained using FIGS. 5 to 7.

Figure 5:
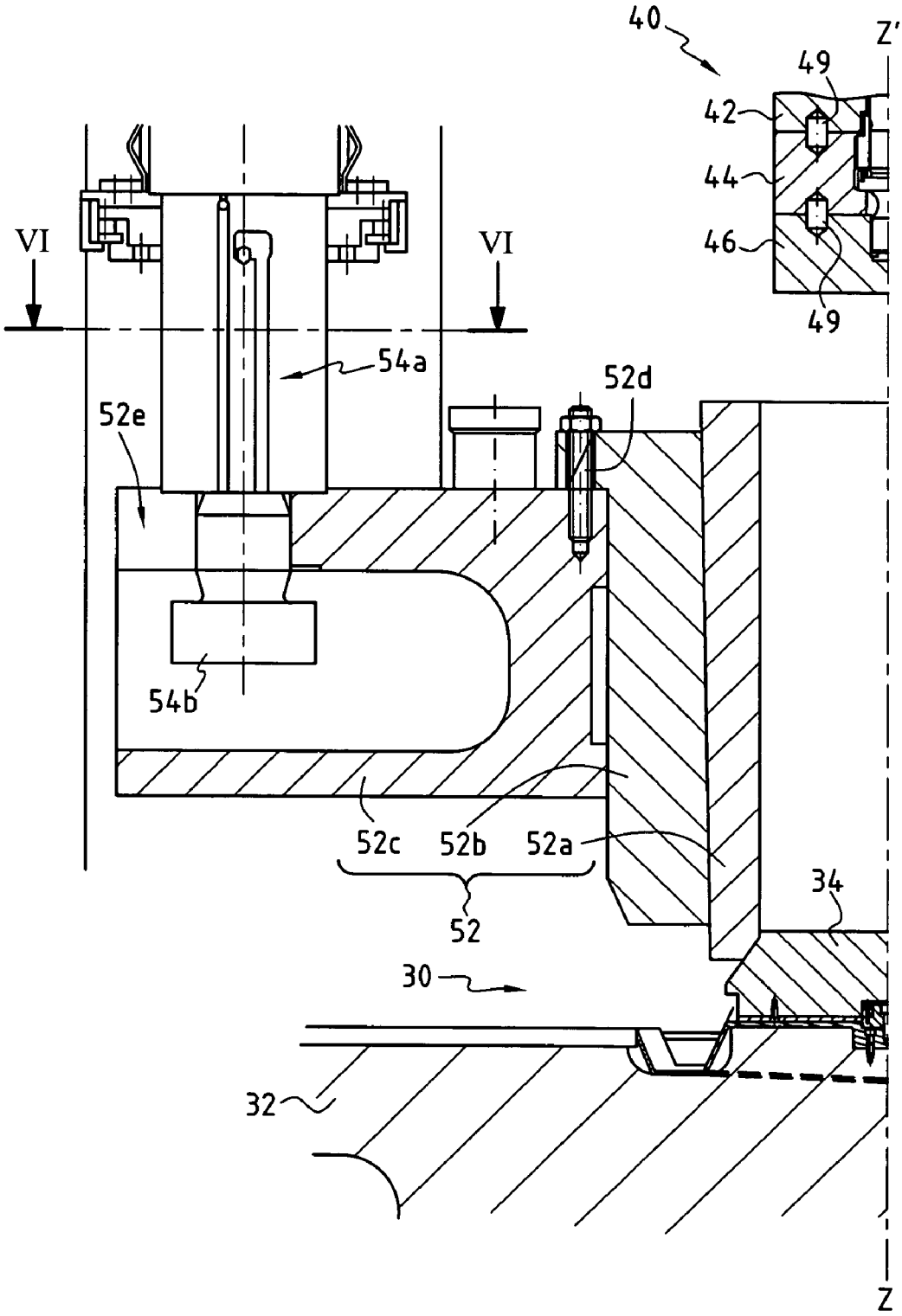
FIG. 5 shows an enlarged view in half-section, through V—V of FIG. 6, of the guide assembly of the compacting section of the press in FIG. 2.

As may be seen from FIGS. 5 and 7, liner 52*a* is shrunk into hoop 52*b*, with the external face of liner 52*a* and the internal face of hoop 52*b* both being slightly flared by becoming narrower towards the base.

Figure 6:
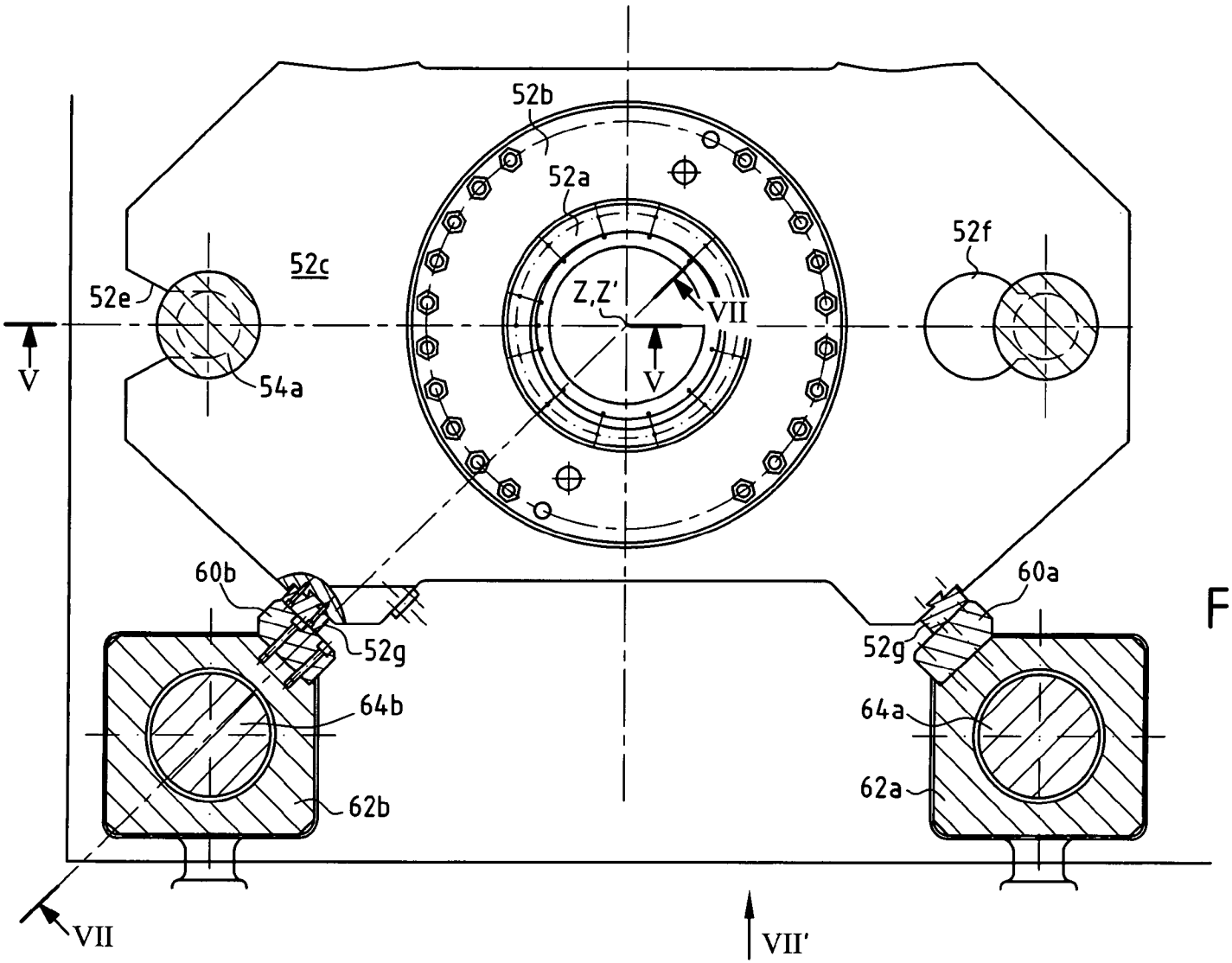
FIG. 6 is a cross-sectional view, through VI—VI in FIG. 5, of the guide assembly for the press in FIG. 2.

Cradle 52*c* encloses hoop 52*b* with two lateral extensions on both sides of vertical axis Z, Z' as shown in more clearly in FIG. 6.

Hoop 52*b* is connected to cradle 52*c* through a nut and bolt assembly 52*d*, as shown in FIG. 5.

The function of skirt 52, formed by the combination of liner 52*a*, hoop 52*b* and cradle 52*c* together, is to guide thrust plate 46 as it descends and to minimise lateral deformation of the case 10 as it is being compacted.

The raising and lowering movement of skirt 52, required only during maintenance operations to fit (and remove) skirt 52 onto (and from) maintenance trolley 100, is achieved by means of two auxiliary pistons 54, the lower sections of which have extensions 54*a* which are fitted (in such a manner that they can be removed) onto cradle 52*c*.

In effect, as shown in FIGS. 5 and 6, extensions 54*a* extend downwards as a downwardly pointing mushroom-shaped lug 54*b*, with the head down.

To match the two lugs 54*b*, the two lateral extensions of cradle 52*c* each have a key-hole shaped opening 52*e* and 52*f* which form slots as shown in FIG. 6.

Openings 52*e* and 52*f* have wide internal sections that 54*b* can fit through and a smaller diameter section. Under pressure these provide locking by vertical suspension of the wider head of lug 54*b* on the upper, effectively horizontal, surface, whilst the foot of lug 54*b* remains inside the part with a smaller diameter.

More precisely, as shown in FIG. 6, opening 52*f* has a keyhole shaped hole whilst opening 52*e* opens out laterally onto the side (left in FIG. 6) of the cradle: this arrangement enables the cradle 52*c* to be fixed more easily onto the two lugs 54*b*, allowing skirt 52 to be suspended on auxiliary pistons 54 (as well as facilitating dismantling of the cradle 52*c* from the two lugs 54*b*).

To guide the vertical translation movement along the vertical axis Z, Z' of the cradle 52*c*, the latter is equipped with four series of shoes 52*g* made from self-lubricating material such as bronze, with each series of shoes preferably made up of three shoes (see FIG. 7) vertically arranged in line one above the other.

These shoes 52*g* rub on four guide-ways 60*a* to 60*d*, each of which is fixed to a corresponding pillar 62*a* to 62*d*, each of which is itself fitted around a pre-stressed column 64*a* to 64*d* on the press.

Two of the four guide-ways have a different structure: as shown in FIG. 7 relating to guide-way 60*b*, these two specific guide-ways each have three horizontal, parallel, open cut-outs 66.

Each series of three cut-outs 66 is arranged so that their position relative to the direction of the vertical Z, Z' axis very closely matches the vertical distribution of the three shoes 52*g* in the corresponding series of shoes.

In this way, when cradle 52*c* is placed at a height designed for the removal of skirt 52 (the maintenance position in which the skirt—the cradle, the band and the liner—rest on the maintenance trolley), shoes 52*g* are aligned horizontally with the cut-outs 66 and may therefore be easily disengaged from the corresponding guide-way at the cut-outs 66 (by moving the skirt horizontally to the right in FIGS. 5 and 6).

It can therefore be seen that under normal operating conditions, shoes 52*g* slide in contact along the external surface of their matching guide-ways 60*a* to 60*d* and that during removal operations (maintenance position), the shoes on the guide-ways with a different structure are to the right (horizontal alignment) of cut-outs 66 to allow the cradle 52*c* to be separated from guide-ways 60*a* to 60*d* (guide-ways 60*a* to 60*d* are themselves fixed solidly to pillars 62*a* to 62*d* which enclose the pre-stressed columns 64*a* to 64*d*).

This removal operation is, of course, carried out when maintenance trolley 100 is above block 34 so that skirt 52 may be carried out of zone A on maintenance trolley 100.

The initial position of press 20 before the operations for removal of the skirt are carried out is that shown in FIGS. 3, 5 or 6.

In particular, at the start of the removal operation, cradle 52*c* is raised using auxiliary pistons 54, which leads to a break in the contact between the liner 52*a* and block 34, and to contact between the upper surface of the head of lug 54*b* and the lower surface of the lateral extensions of cradle 52*c* next to openings 52*e* and 52*f*: the lugs 54*b* which are then fixed firmly to the cradle 52*c*, because they are located in the narrower zone of openings 52*e* and 52*f*, bring the skirt that is suspended in this way upwards as the pistons 54 are gradually raised.

Maintenance chariot 100 is then brought beneath skirt 52, over the block and support beam 32.

Auxiliary pistons 54 are then actuated to lower skirt 52 onto maintenance chariot 100: the removable spacers 59 (see FIGS. 8 and 9 and explanations further on) which limit the downward travel of the auxiliary pistons that have been placed in maintenance position are then put in place: in this position the cradle can be placed onto the maintenance trolley 100. In this position also, shoes 52*g* of cradle 52*c* are aligned at the same height as cut-outs 66 in the two guide-ways 60*a* and 60*c* and the cradle can be then taken out of the compacting cell (zone A).

In order to do this, maintenance chariot 100 is then moved horizontally a short distance so that on one hand shoes 52*g* may be disengaged by passing through cut outs 66, and so that on the other hand the mushroom shaped lugs 54*b* which form the bottom extremities of the extensions 54*a* to auxiliary pistons 54 may be placed exactly in line with the matching openings 52*e* and 52*f*.

Then lugs 54*b* are fully freed from the cradle 52*c* by subsequently raising once again the auxiliary pistons 54, with skirt 52 (made up of liner 52*a*, band 52*b* and cradle 52*c*) then resting on trolley 100 and being free of any attachments.

The chariot is then moved from zone A towards zone C (FIG. 1) to allow maintenance operations to be carried out on skirt 52. To this end skirt 52 is taken from trolley 100 using a lifting beam assembly which allows skirt 52 to be moved to zone C from where it will be conveyed towards a maintenance zone.

Figure 8:
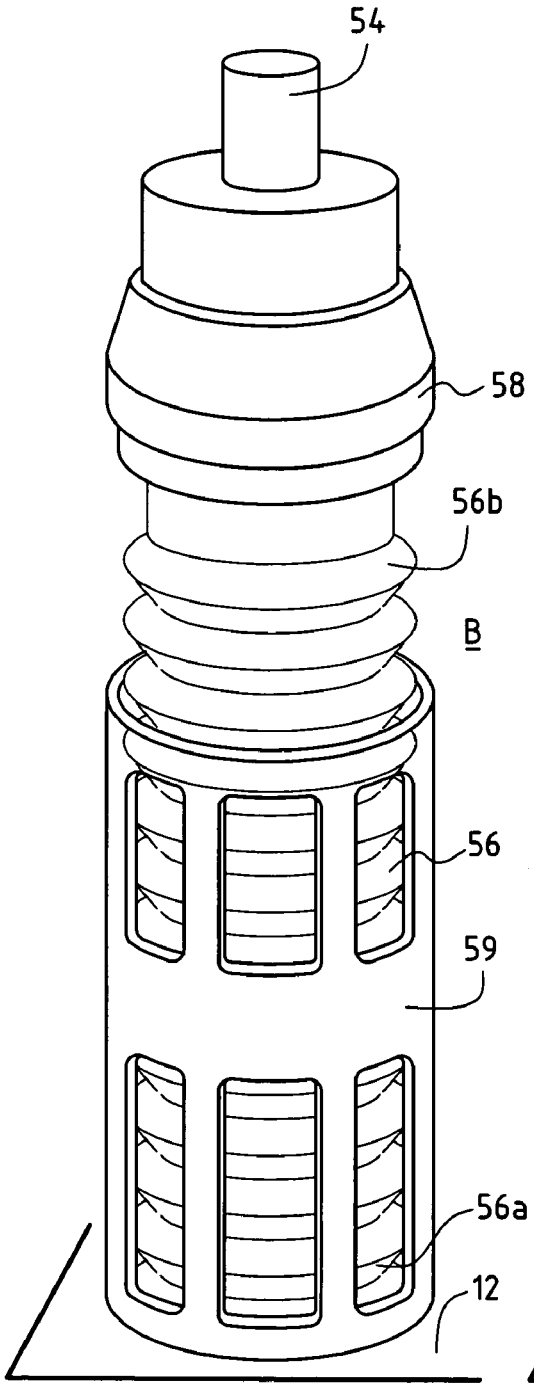
FIGS. 8 and 9 are perspective views, with and without application of pressure respectively, of another part of the press guide assembly which forms detail VIII in FIG. 2.
Figure 9:
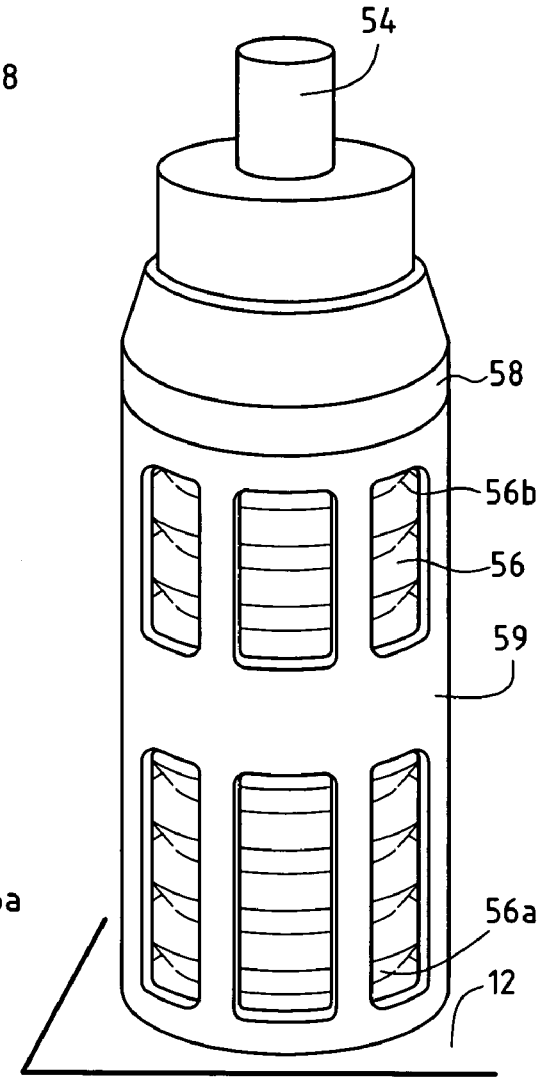

Another zone of the press 20 which makes up detail VIII in FIG. 2 is now described in relation to FIGS. 8 and 9.

The purpose of the arrangement which will now be described is to facilitate the precise positioning in terms of height of skirt 52 in its maintenance position with shoes 52*g* lining up with cut-outs 66 to allow the release of skirt 52.

To this end, the upper sections (zone B) of both auxiliary pistons 54 are enclosed in a removable sealed bellows 56, which is itself surrounded by a removable spacer 59 which has a part in limiting the vertical travel of the support section of skirt 52 (auxiliary pistons 54). In this way, when it is placed as shown in FIGS. 8 and 9, spacer 59 reduces the vertical descent travel of auxiliary piston 54 (skirt piston) so that the aforementioned maintenance position may be attained.

There is a sealed connection between the lower extremity 56*a* of both bellows 56 and partition 12 separating zones A and B, with only zone A being in communication with the interior of bellows 56. The bellows therefore forms a sealing device between lower zone A and upper zone B.

This is possible since the upper extremity 56*b* of bellows 56 is fixed onto (around) the piston rod of auxiliary piston 54 (skirt piston) to form a seal. An end stop 58 which forms an annular cover is also fitted at this location so that it is coaxial with auxiliary piston 54 and fitted around the upper end 56*b* of bellows 56.

When it is used, spacer 59 (made using a length of sleeving), is then placed around the lower end 56*a* of bellows 56, pressing on partition 12 and above the upper surface of partition 12.

The length of the sleeve that forms spacer 59 and positioning of the end stop 58 on the piston rod 54 is designed so that as is shown in FIG. 9, when the piston rod of piston 54 descends, the aforementioned maintenance position corresponds to the position in which the lower edge of end stop 58 is supported on the upper edge of spacer 59.

It is therefore in this position that skirt 52, or more precisely cradle 52*c*, may be released from its holding section, in particular from auxiliary skirt pistons 54 and from the connection with pre-stressed columns 64*a* to 64*d* (using cut-outs 66), by horizontal movement towards the right of FIG. 6. At the end of this movement, the mushroom-shaped lugs 54*b* will be in line in relation to openings 52*e* and 52*f*, which allows skirt 52 to be fully released, as described earlier.

The invention claimed is:

1. A press for compacting a case containing hazardous materials, especially radioactive waste, made up of:

a section for supporting the case, fitted with a block which is mounted in a removable manner onto a lower support beam, a compacting section which can undergo translational movement along a vertical axis (Z, Z'), mounted above the support section and equipped with a thrust plate forming a ram designed to compress the case by application of pressure, and a guide assembly for the compacting section, intended to receive one free end of the said compacting section and, enclosing the case, the guide assembly comprised of a skirt with:

a liner resting on the block of the support section, designed to tightly enclose the outside of the case, a hoop encircling and fixed to the liner, and a cradle is mounted to the hoop with a removable assembly, the cradle being mounted by means of a removable connection onto a skirt holding section, which can undergo vertical translation movement, with the removable connection including a reversible assembly system having a detachable engagement coupling between the skirt holding section and the cradle to provide for relative horizontal translation movement between the skirt holding section and the cradle, the relative horizontal translation movement taking place in one plane, between the cradle and the holding section when said skirt is placed in a maintenance position, wherein the reversible assembly system comprises at least one opening in the form of a key-hole which passes through the cradle vertically and at least one lug directed vertically downwards from the skirt holding section.

2. The press according to claim 1 further comprising means of limiting the vertical travel of the holding section of the skirt for placing the skirt and the holding section in the maintenance position.

3. The press according to claim 1 wherein the reversible assembly system comprises two key hole shaped openings forming a slot, arranged on the cradle and passing through the cradle vertically, and two matching mushroom-shaped lugs directed vertically downwards and arranged on the skirt holding section, with assembly and disassembly of the removable connection being carried out by fitting together and horizontal translation of the lugs in the openings while in the maintenance position.

4. The press according to claim 3 wherein at least one of the two openings, opens out laterally.

5. The press according to claim 1, wherein the skirt holding section includes a piston rod of at least one auxiliary cylinder.

6. The press according to claim 2, wherein the skirt holding section includes a piston rod of at least one auxiliary cylinder wherein the limiting means includes an end stop and a removable spacer, said end stop being fitted so that it is fixed to the piston rod above the spacer so that contact between the end-stop and the spacer prevents the piston rod from descending and places the piston rod in the maintenance position.

7. The press according to claim 1 wherein the guide assembly includes at least three columns surrounding the support section and the compacting section, the columns being fitted with guide-ways which extend vertically, the cradle being equipped with at least three shoes, with each shoe being designed to slide vertically against a matching guide-way.

8. The press according to claim 7, wherein at least one of the guide-ways is fitted with at least one cut-out where the shoes may be made to emerge from the guide-way by means of a horizontal movement.

9. The press according to claim 8, comprising four guide-ways each guide-way is fitted to a respective columns, with at least two of the guide-ways being equipped with at least one cut-out.

10. The press according to claim 1, wherein the compacting section further includes an intermediate thrust-plate positioned on top of the thrust-plate, and a ram cylinder fitted above the intermediate thrust-plate and a fixing assembly connecting together the thrust-plate, the intermediate thrust-plate and the ram-cylinder, the compacting section being cylindrical in cross section around the vertical axis (Z, Z'), with the fixing assembly comprising A fixing rod that is coaxial with the vertical axis (Z, Z') with the lower extremity of the fixing rod passing into the bore of the intermediate thrust-plate with the fixing rod threaded onto a threaded insert mating with a internal thread forming a portion of the bore of the intermediate thrust-plate, a dynamometric screw whose lower end is threaded and which mates with an internal thread in the thrust-plate, with the upper end of the dynamometric screw being connected to the fixing rod and to the intermediate thrust-plate by means of a threaded insert, with the dynamometric screw having an intermediate zone with a fragile section.

11. A press according to claim 1, wherein the lower support beam is connected to a centering component which mates with the base of the block, with the block having a lateral face which has an upper portion in the form of a truncated cone which gets larger towards the base and a lower portion which forms a recessed shoulder.

* * * * *